US007798883B2

(12) United States Patent
Elson et al.

(10) Patent No.: US 7,798,883 B2
(45) Date of Patent: Sep. 21, 2010

(54) ACROBATIC ROTARY-WING TOY HELICOPTER

(75) Inventors: James E. Elson, Toronto (CA); Charles Sink, Friday Harbor, WA (US)

(73) Assignee: Spin Master Ltd., Toronto, Ontario (CA)

( * ) Notice: Subject to any disclaimer, the term of this patent is extended or adjusted under 35 U.S.C. 154(b) by 277 days.

(21) Appl. No.: 12/072,270

(22) Filed: Feb. 25, 2008

(65) Prior Publication Data

US 2009/0215355 A1 Aug. 27, 2009

(51) Int. Cl.
*A63H 27/127* (2006.01)

(52) U.S. Cl. ..... 446/37; 446/232

(58) Field of Classification Search ..... 446/30–45, 446/230, 231, 232; 244/17.11, 17.13
See application file for complete search history.

(56) References Cited

U.S. PATENT DOCUMENTS 5,571,038 A * 11/1996 Halling ..... 446/232
6,672,538 B2 1/2004 Millea et al.
6,688,936 B2 2/2004 Davis
2006/0231677 A1* 10/2006 Zimet et al. ..... 244/17.23
2009/0163110 A1* 6/2009 Van de Rostyne et al. ..... 446/37

FOREIGN PATENT DOCUMENTS

CA 2 497 323 A1 9/2004
CA 2 569 609 A1 3/2007
CA 2 544 980 A1 5/2007

OTHER PUBLICATIONS

International Search Report and Written Opinion, International Application No. PCT/CA2009/000205.

* cited by examiner

*Primary Examiner*—Nini Legesse
(74) *Attorney, Agent, or Firm*—Cohen Pontani Lieberman & Pavane LLP

(57) ABSTRACT

A rotary-wing toy helicopter generally comprising a transverse shaft, a plane body fixedly attached to the transverse shaft and a rotor assembly rotatably attached to the transverse shaft. The rotor assembly generally comprises a primary drive connected to a drive shaft for driving at least one set of lifting blades and a secondary drive connected to the transverse shaft for driving rotation of the transverse shaft and the plane body clockwise or counter-clockwise around the axis of transverse shaft.

8 Claims, 6 Drawing Sheets

ACROBATIC ROTARY-WING TOY HELICOPTER

BACKGROUND OF THE INVENTION

1. Field of the Invention

This invention relates to rotary-wing vehicles and in particular to rotary-wing toy helicopters.

2. Description of Related Art

A helicopter typically has two main rotor blades that are connected through a drive shaft to an engine. The air deflected downwards due to the spinning of the main rotor blades provides the lilting power. Rotor blades at the tail of the helicopter are directed in the horizontal plane to provide the anti-torque power that is required to prevent the helicopter from rotating due to the spinning main rotor blades. Changing the main rotor blades attack angle provides horizontal motion according to pilot's commands.

Sikorsky and Kamov first introduced a helicopter with two counter-rotating main rotors on a common axis. Eliminating the need for tail rotor blades, the counter-rotating blades provide higher maneuverability and stability.

There are various kinds of toy helicopters known in the art, some incorporating counter rotating rotors on a common axis. Most toy helicopters feature a form that has the appearance of a helicopter. A toy helicopter featuring a form that has the appearance of a plane and, when in flight, can appear to be a plane doing acrobatic stunts is not found in the prior art.

SUMMARY OF THE INVENTION

The toy helicopter described herein provides a vehicle with a rotor assembly, which provides lift and steering control, and an airplane-like body that can rotate around the rotor assembly without causing flight instability due to movement of the toy helicopter's center of gravity or other aerodynamic disturbances. The purpose of the rotation of the airplane-like body is to provide the toy helicopter with the appearance of an airplane performing aerial stunts.

Accordingly, there is described herein embodiments of the applicants' toy helicopter. In one aspect, there is provided a rotary-wing toy helicopter comprising: a transverse shaft; a plane body fixedly attached to the transverse shaft, the plane body comprising a nose end and a tail end; and a rotor assembly rotatably attached to the transverse shaft, the rotor assembly comprising: a primary drive means connected to a drive shaft for driving at least one set of lifting blades, the drive shaft being generally perpendicular to the longitudinal axis of the transverse shaft; a secondary drive means connected to the transverse shaft for driving rotation of the transverse shaft and the plane body clockwise or counterclockwise around the longitudinal axis of the transverse shaft, the plane body being selectively retainable at angles between 0 and 360 degrees relative to the drive shaft; and control means for controlling the primary drive means and the secondary drive means.

In other aspects, the transverse shaft passes approximately through the center of gravity of the toy helicopter. The toy helicopter may also be adapted to perform yawing motions. This may be accomplished by providing a coaxial drive shaft and having the primary drive means connected to the coaxial drive shaft for driving at least two sets of lifting blades, the two sets of lifting blades being located one above the other. The primary drive means drives a first set of the lifting blades in a first direction of rotation, and a second set of the lifting blades in a second direction of rotation opposite to the first direction. In this way, side forces are developed, which can be used to turn the toy helicopter clockwise or counter clockwise on a horizontal plane. The plane body of the toy helicopter may be weighted to position the horizontal center of gravity of the toy helicopter in front of the drive shaft when the nose end of the plane body is in front of the drive shaft or behind the drive shaft when the nose end of the plane body is behind the drive shaft. The toy helicopter will fly in a forward direction when the nose end of the plane body is in front of the drive shaft and in a backward direction when the nose end of the plane body is behind the drive shaft.

It is to be understood that other aspects of the present toy helicopter will become readily apparent to those skilled in the art from the following detailed description, wherein various embodiments are shown and described by way of illustration. As will be realized, the toy helicopter is capable of other and different embodiments and its several details are capable of modification in various other respects, all without departing from the spirit and scope of the toy helicopter described. Accordingly, the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the applicant's toy helicopter are illustrated by way of example, and not by way of limitation, in detail in the figures, wherein.

DETAILED DESCRIPTION OF THE PRESENTLY PREFERRED EMBODIMENTS

The applicants' rotary-wing toy helicopters are herein described in detail. One of the toy helicopters generally comprises a rotor assembly 110, a transverse shaft 125 and a plane body 130.

Figure 1:
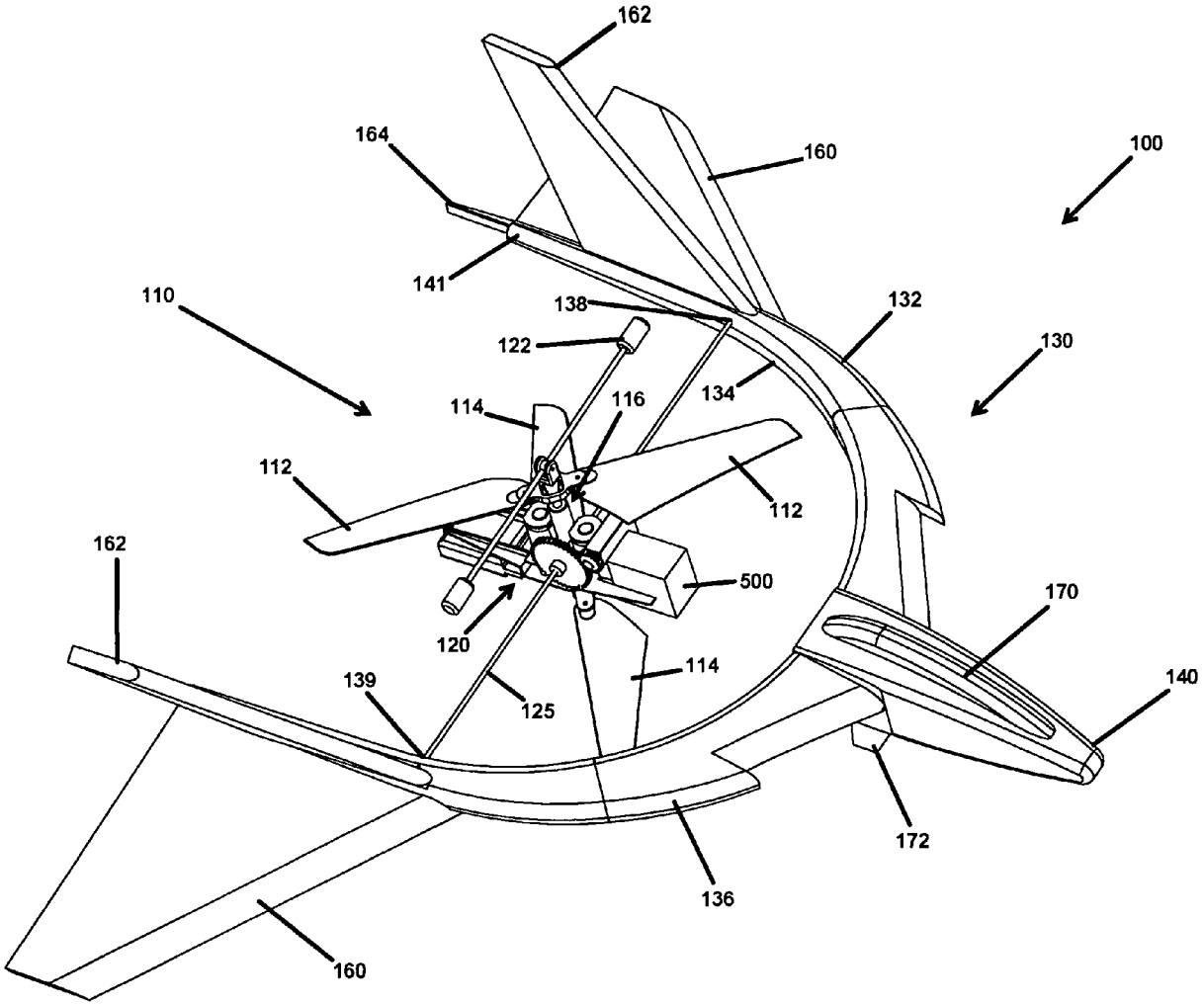
FIG. 1 shows a perspective view of one of the applicants' toy helicopters.

FIG. 1 shows an embodiment of the applicants' toy helicopter 100. The rotor assembly 110 is located approximately at the center of the toy helicopter 100. Generally, the rotor assembly comprises a primary drive means connected to a drive shaft for driving at least one set of blades.

With reference to the embodiment of FIGS. 1 to 4, the rotor assembly 110 comprises two sets of blades located one above the other, upper set 112 and lower set 114. The upper set of blades 112 is driven in a first direction of rotation and the lower set of lifting blades 114 is driven in a second direction of rotation opposite to the first direction. The two sets of blades 112 and 114 provide lifting force for the toy helicopter 100 during take-off and while in flight. The counter-rotating movement of the two sets of blades 112, 114, cancel each other's angular torque and provide stability. For aerodynamic efficiency, the two sets of blades can have an airfoil shaped cross section.

A coaxial drive shaft assembly 116 provides rotating power to the two sets of lifting blades 112, 114. The coaxial drive shaft assembly 116 comprises two parts: an outer drive shaft 117 and an inner drive shaft 118. A primary drive means 120 provides rotating power to the coaxial drive shaft assembly 116. The primary drive means 120 may comprise, for example, an outer drive shaft motor 121*a* and a separate inner drive shaft motor 121*b*. Outer drive shaft 117 is driven by the outer drive shaft motor 121*a* to provide rotating power to the upper set of blades 112. Inner drive shaft 118 is driven by the inner drive shaft motor 121*b* to provide rotating power to the lower set of blades 114. Power for the drive means is provided by a battery 119, which may be a lithium-ion polymer battery (LiPo) or some other suitable power source. The two parts of coaxial drive shaft 116 rotate in opposite directions and can be driven at different speeds, if required, for steering the toy helicopter 100 in the air. When the two sets of blades are driven at different relative speeds, side forces are developed which can be used to yaw the toy helicopter, i.e. turn the toy helicopter clockwise or counterclockwise. As will be appreciated by those skilled in the art, other means for steering the toy helicopter could be used, for example, lateral propellers. The rotor assembly also includes a secondary drive means 150 described below.

The rotor assembly 110 may include bell stabilizers 122 connected to the coaxial drive shaft 116 adjacent the upper 112 and/or lower set of blades 114.

The rotor assembly 110 is rotatably attached to the transverse shaft 125 at approximately the midpoint of the transverse shaft. The transverse shaft 125 extends from both sides of the rotor assembly 110 generally perpendicular to the longitudinal axis of the drive shaft assembly 116. The transverse shaft 125 connects the rotor assembly 110 to the plane body 130 and extends approximately through the center of gravity of the toy helicopter 100.

The plane body 130 of toy helicopter 100 is fixedly attached to the transverse shaft 125 and rotates with the transverse shaft. The plane body 130 is sized and adapted to rotate around the rotor assembly 110 without contacting the rotor assembly and without causing instability when the toy helicopter is in flight.

With reference to FIGS. 1 to 4, the plane body 130 can be, for example, an arcuate plane body. The plane body has a nose end 140 and a tail end 141. The plane body 130 generally comprises a fuselage 132 in the approximate form of a cylinder longitudinally curved into a major arc. The plane body 130, therefore, has an interior surface 134 facing toward the center of the major arc and an exterior surface 136 facing away. As will be appreciated by those skilled in the art, other fuselage shapes could be used.

The interior surface 134 of the plane body 130 is fixedly connected at two points 138 and 139 to the two ends of the transverse shaft 125, the transverse shaft tracing a chord between points on the major arc of the plane body 130. The chord is long enough that the plane body 130 can be rotated 360 degrees around the transverse shaft 125 without contacting any part of the rotor assembly 110. Furthermore, the plane body 130 can be rotated around the transverse shaft 125 to any angle relative to the drive shaft without shifting the center of gravity of the toy helicopter 100 enough to cause instability that adversely affects the flight of the toy helicopter.

The applicants' toy helicopter generally comprises a means for flying in at least one of a forward direction or a backward direction. With reference to FIG. 1, the toy helicopter 100 is adapted to fly in at least of a forward direction or a backward direction based on the position of the plane body 130 relative to the coaxial drive shaft 116. The plane body 130 of the toy helicopter is weighted to position the horizontal center of gravity of the toy helicopter in front of the coaxial drive shaft when the nose end 140 of the plane body is in front of the coaxial drive shaft 116. Conversely, when the plane body is rotated so that the nose end of the plane body is behind the coaxial drive shaft, the horizontal center of gravity of the toy helicopter is behind the coaxial drive shaft.

When the toy helicopter 100 is airborne, the toy helicopter, including the two sets of lifting blades 112, 114, tilts in the direction of the toy helicopter's center of gravity. Accordingly, when the nose end 140 of the plane body 130 is in front of the coaxial drive shaft 116, the lifting blades tilt forward and their rotation generates a component of forward thrust. Thus, the toy helicopter flies in a forward direction. Conversely, when the nose end 140 of the plane body is behind the drive shaft, the toy helicopter flies in a backward direction. When the nose end of the plane body is approximately centered above or below the drive shaft 160, the toy helicopter does not move in the horizontal plane.

The secondary drive means or body rotation motor 150 is mounted to the rotor assembly 110. The secondary drive means drives the rotation of the transverse shaft 125 and plane body 130 clockwise or counter-clockwise around the longitudinal axis of the transverse shaft. In flight, the plane body 130 of the toy helicopter 100 is selectively retainable at angles between 0 and 360 degrees relative to the coaxial drive shaft 116. The secondary drive means 150 is, for example, a servo or a motor that drives the rotation of the transverse shaft 125 and the plane body 130 via a gear set 152 connecting the secondary drive means to the transverse shaft 125.

Figure 2:
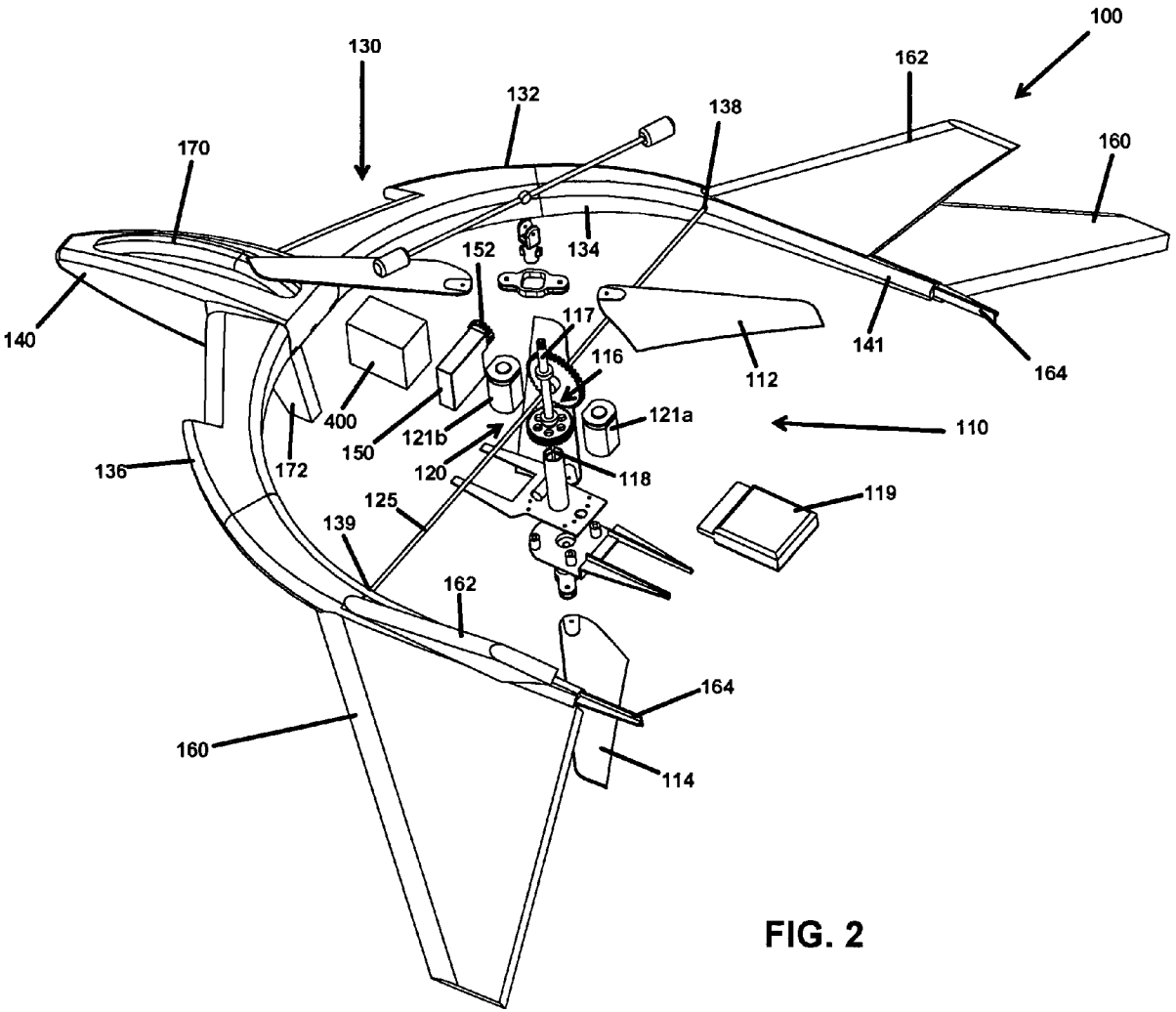
FIG. 2 shows an exploded schematic view of the toy helicopter of FIG. 1.

The plane body 130 can include additional portions that support the toy helicopter when the toy helicopter has landed. These portions can also give the toy helicopter the appearance of a plane. With reference to FIGS. 1 and 2, a cockpit portion 170 extends from the exterior surface 136 of the nose end 140 of the plane body 130 at approximately the mid-point of the major arc of the plane body. Cockpit portion 170 extends generally parallel to the plane of the plane body. A landing support 172, integral with the cockpit portion 170, extends downward from the cockpit portion.

Lower fins 160 extend downward from the surface of the plane body 130. The lower fins extend the same distance below the plane of the plane body as the landing support 172 of the cockpit portion 170. An assembly support 124 (see FIG. 4) can also extend downward from the bottom of the rotor assembly 110. Together, the landing support 172, the assembly support 124 and the lower fins 160 support the toy helicopter in a horizontal landing position.

The toy plane 100 also comprises upper fins 162 extending upward from the surface of the plane body. Landing legs 164 extend from the endpoints of the major arc of the plane body. The upper fins 162, lower fins 160 and landing legs 164 extend the same distance rearwardly of the plane body 130. As will be appreciated by those skilled in the art, end-portions of the upper fins 162, lower fins 160 and landing legs 164 are aligned in the same plane and can support the toy helicopter in a vertical landing position wherein the cockpit portion 170 is pointing up (see, for example, FIG. 1).

Figure 3:
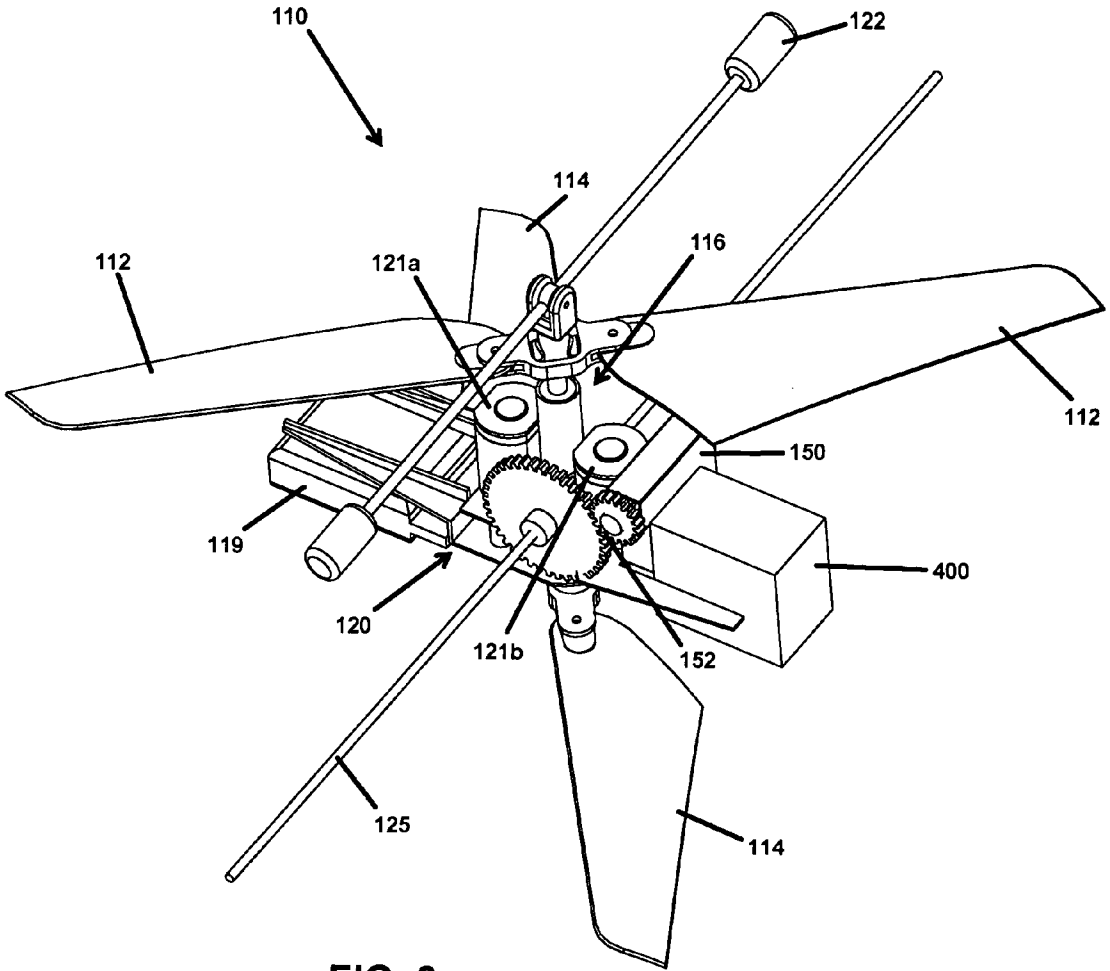
FIG. 3 shows a perspective view of a rotor assembly of the toy helicopter of FIG. 1.
Figure 4:
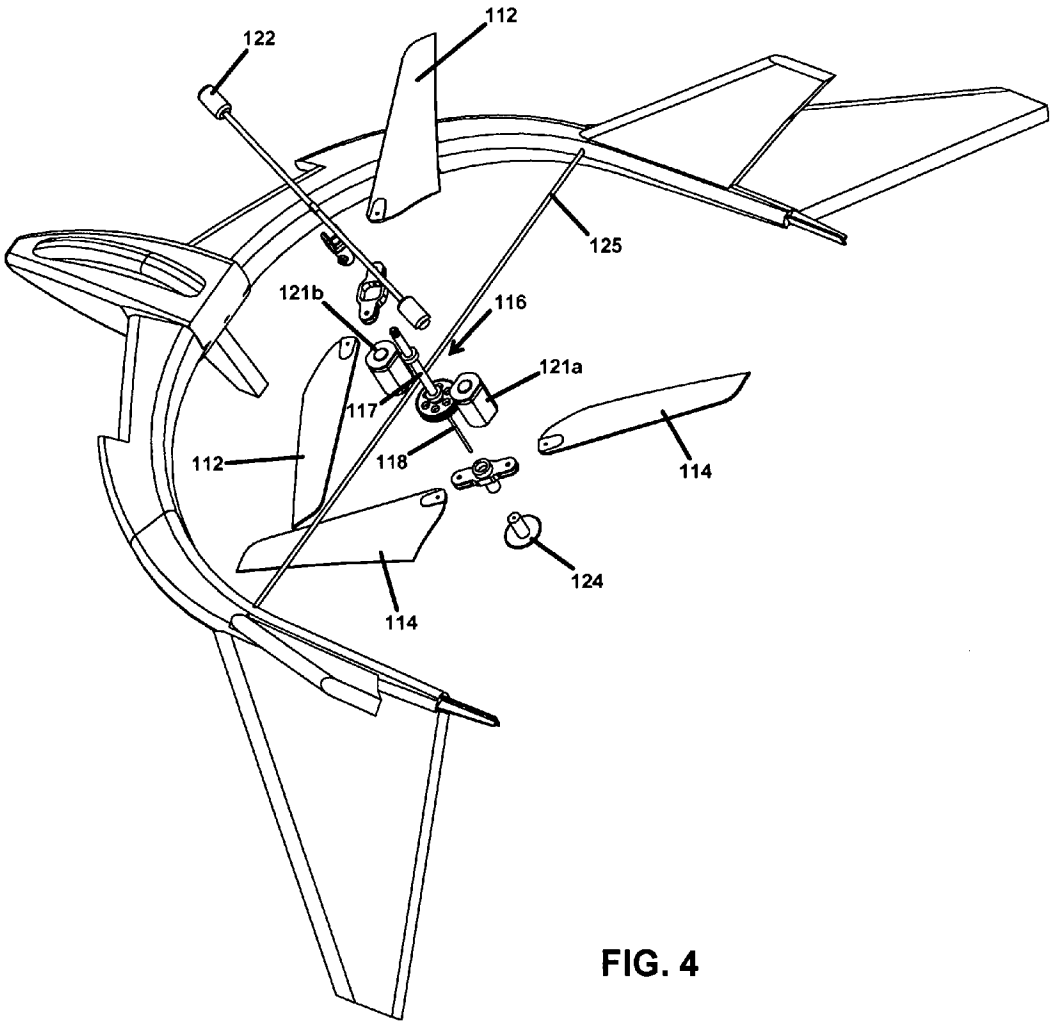
FIG. 4 show a partial exploded view of the toy helicopter of FIG. 1, showing a portion of the rotor assembly only.
Figure 5:
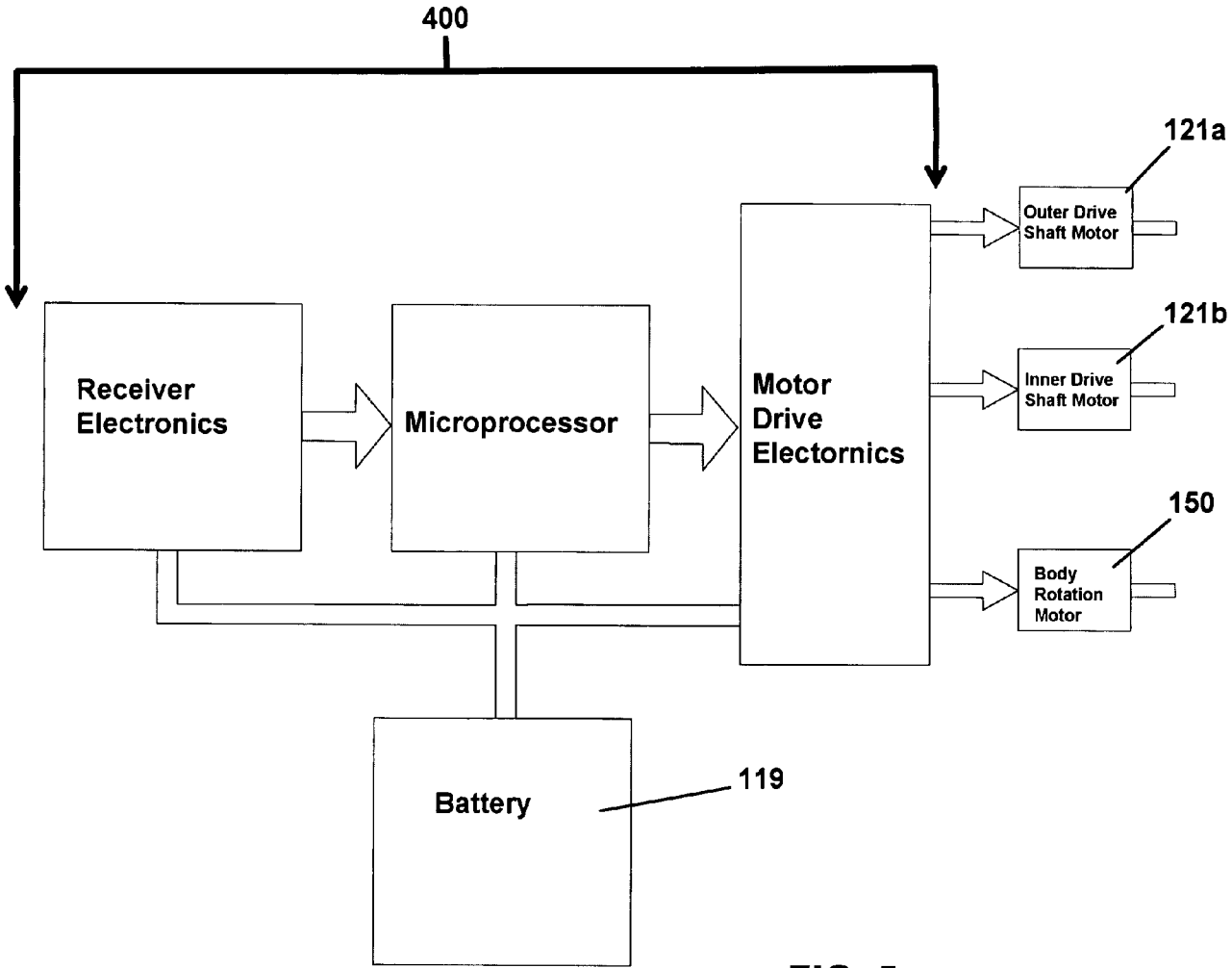
FIG. 5 is a block diagram of the control assembly for the applicants' toy helicopters.

The control means of the toy helicopter are for controlling, at least, the primary and secondary drive means 120, 150 of the toy helicopter. With reference to FIGS. 2, 3, and 4 control means are, for example, an electronic control assembly 400. Control assembly 400 controls the operation of the toy helicopter 100.

Control assembly 400 may comprise toy-based electronics known in the art, for example, RX2C based electronics. Control assembly 400 may have remote control capabilities and may have a microprocessor, including memory. A receiver of the control assembly 400 is for receiving remote control commands. Such a receiver may be of radio frequency (RF), light such as infrared (IR), or sound such as ultra sound, or voice commands. Control assembly 400 also includes motor drive electronics for controlling outer and inner drive shaft motors 121*a* and 121*b* and body rotation motor 150.

Power assembly 119 provides power to all drive means and control means of the toy helicopter 100. Power assembly 119 may be a rechargeable battery, such as a lithium polymer cell, simple battery, capacitance device, super capacitor, micro power capsule, fuel cells, fuel or other micro power sources. Control Assembly 400 may incorporate monitoring circuitry for the power assembly 119.

Figure 6:
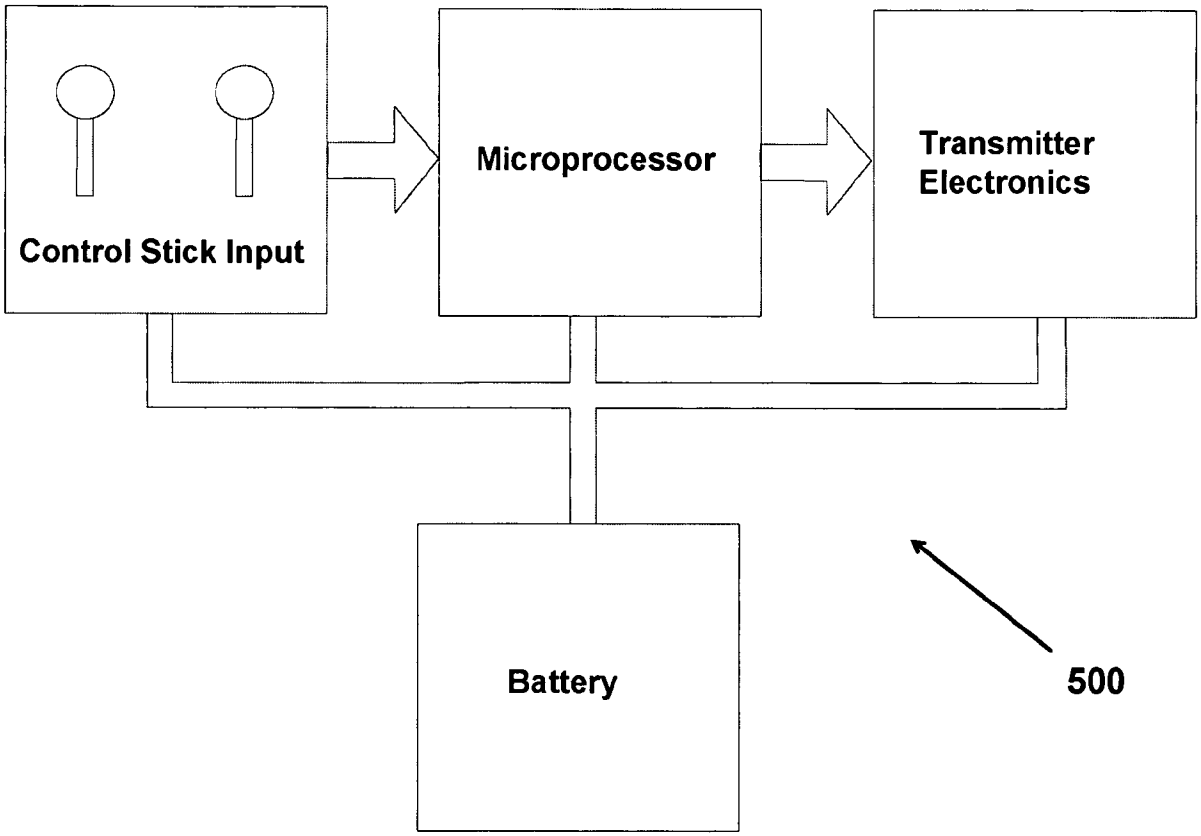
FIG. 6 is a block diagram of the remote control unit for the applicants' toy helicopters.

A remote control unit 500, see FIG. 6, may preferably be used by an operator to control the toy helicopter 100, in particular, for transmitting remote user commands to the control means 400 of the toy helicopter. The remote control unit may comprise toy-based electronics known in the art, for example, TX2C based electronics. Remote control unit 500 may comprise a microprocessor with memory, transmitter electronics, joy stick inputs including a throttle control, a steering control and a plane body control for controlling movements of the toy helicopter in flight, and a power supply. User inputs at the remote control unit 500 are executed by the control means, for example, control assembly 400 of toy helicopter 100.

The transmitter of the remote control unit 500 is, for example, a wave radiation transducer such as an RF antenna. The remote control unit 500 may also have charging circuitry for charging the power assembly 119 of toy helicopter 100. The remote control unit 500 may also incorporate a power switch and indicators for various information such as power on/off, charging, battery status, and the like.

A description of the operation of one embodiment of the toy helicopter 100 follows. To take off, the throttle control on the remote control unit is increased, which signals the vehicle control assembly 400 to actuate the primary drive means, thereby rotating the two sets of lifting blades 112, 114. The toy helicopter 100 lifts off the ground when the speed of the two sets of rotor blades 112, 114 is sufficient to provide the necessary lift. Increasing the throttle will increase the altitude.

Once airborne, controls on the remote control unit 500 can be used to rotate the plane body 130 of the toy helicopter 100 around the rotor assembly 110, thus providing the toy helicopter with the appearance of an airplane performing aerial stunts. The plane body rotates around the rotor assembly without causing flight instability.

Forward and backward flight of the toy helicopter is also accomplished by adjusting the plane body controls on the remote control unit, which causes the plane body 130 to rotate around the rotor assembly 110. As described above, the toy helicopter 100 will fly forward when the nose end 140 of the plane body 130 is forward of the drive shaft assembly 116 and fly backward when the nose end 140 of the plane body is behind the drive shaft assembly 116.

Steering of the toy helicopter is accomplished by adjusting the left/right controls on the remote control unit 500, which causes the upper and lower sets of counter-rotating blades 112, 114 to be driven at different relative speeds.

In preparation for landing, a command may be sent from the remote control unit 500 to the control assembly 400 to rotate the plane body 130 into a vertical position, so that cockpit portion 170 is generally parallel with the drive shaft 116, for a vertical landing. Alternatively, the plane body 130 may be rotated into a horizontal position, generally perpendicular to the dive shaft, for a horizontal landing. When power to the throttle is reduced, the altitude of the toy helicopter 100 drops and the toy helicopter can be gently landed on a ground surface.

The previous detailed description is provided to enable any person skilled in the art to make or use the present toy helicopter. Various modifications to those embodiments will be readily apparent to those skilled in the art, and the generic principles defined herein may be applied to other embodiments without departing from the spirit or scope of the toy helicopter described herein. Thus, the present toy helicopter is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed is:

1. A rotary-wing toy helicopter comprising:

a transverse shaft;

a plane body fixedly attached to said transverse shaft, said plane body comprising a nose end and a tail end; and a rotor assembly rotatably attached to said transverse shaft, said rotor assembly comprising:

a primary drive means connected to a drive shaft for driving at least one set of lifting blades, said drive shaft being generally perpendicular to the longitudinal axis of said transverse shaft;

a secondary drive means connected to said transverse shaft for driving rotation of said transverse shaft and said plane body clockwise or counterclockwise around the longitudinal axis of said transverse shaft, said plane body being selectively retainable at angles between 0 and 360 degrees relative to said drive shaft; and control means for controlling said primary drive means and said secondary drive means.

2. The toy helicopter of claim 1, wherein said transverse shaft passes approximately through a center of gravity of the toy helicopter.

3. The toy helicopter of claim 1, wherein said drive shaft is a coaxial drive shaft; and said primary drive means is connected to said coaxial drive shaft for driving at least two sets of lifting blades, said two sets of lifting blades being located one above the other; and wherein said primary drive means drives the at least two sets of lifting blades at an angular velocity, a first set of said lifting blades being driven by said primary drive means in a first direction of rotation, and a second set of said lifting blades being driven by said primary drive means in a second direction of rotation opposite to said first direction.

4. The toy helicopter of claim 3, wherein said first set and said second set of lifting blades are independently rotatable at different relative speeds for rotating the toy helicopter clockwise or counterclockwise on a horizontal plane.

5. The toy helicopter of claim 1, wherein a horizontal center of gravity of the toy helicopter is approximately centered on said drive shaft when said plane body is generally parallel to said drive shaft.

6. The toy helicopter of claim 5, wherein said plane body of the toy helicopter is weighted to position the horizontal center of gravity of the toy helicopter:

in front of said drive shaft when said nose end of said plane body is in front of said drive shaft;

behind said drive shaft when said nose end of said plane body is behind said drive shaft.

7. The toy helicopter of claim 6, wherein said control means respond to a user command to fly in a forward direction by rotating said nose end of said plane body in front of said drive shaft.

8. The toy helicopter of claim 6, wherein said control means respond to a user command to fly in a backward direction by rotating said nose end of said plane body behind said drive shaft.

* * * * *